US007331728B2

(12) United States Patent
Sanada et al.

(10) Patent No.: US 7,331,728 B2
(45) Date of Patent: Feb. 19, 2008

(54) PRINTER HAVING A PLATEN

(75) Inventors: Tsuyoshi Sanada, Liho Liho Rise (SG); Kiyotaka Nihashi, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/081,283

(22) Filed: Mar. 16, 2005

(65) Prior Publication Data

US 2006/0210345 A1 Sep. 21, 2006

(51) Int. Cl.
*B42J 11/00* (2006.01)

(52) U.S. Cl. ..... 400/648; 400/58; 400/656; 400/55; 400/56; 101/78; 101/93; 101/93.41

(58) Field of Classification Search ..... 400/648, 400/58, 656, 56, 654, 662, 660.3, 660, 649; 101/93.41, 93.04

See application file for complete search history.

(56) References Cited

U.S. PATENT DOCUMENTS 4,247,207 A * 1/1981 Klimek et al. ..... 400/124.07
4,583,272 A * 4/1986 Keller ..... 492/53
4,748,457 A * 5/1988 Quedens ..... 346/136
4,957,382 A * 9/1990 Delaney et al. ..... 400/656
5,816,724 A * 10/1998 Hada et al. ..... 400/656
5,879,091 A * 3/1999 De Ambrogio et al. ..... 400/656
5,940,092 A * 8/1999 Kashimura et al. ..... 347/8
6,171,001 B1 * 1/2001 Nonaka ..... 400/58
6,394,672 B1 * 5/2002 Murray et al. ..... 400/58
6,561,641 B1 * 5/2003 DeFosse et al. ..... 347/104
6,588,955 B1 * 7/2003 Cassiano ..... 400/656
6,669,382 B2 * 12/2003 Takenoshita et al. ..... 400/56
2002/0136577 A1 * 9/2002 Takenoshita et al. ..... 400/58
2005/0226672 A1 * 10/2005 Keller ..... 400/662

FOREIGN PATENT DOCUMENTS

JP 61078674 A * 4/1986
JP 2001-22878 A 1/2001

* cited by examiner

*Primary Examiner*—Ren Yan
*Assistant Examiner*—Matthew Marini
(74) *Attorney, Agent, or Firm*—Frishauf, Holtz, Goodman & Chick, P.C.

(57) ABSTRACT

A printer includes a print head for printing on a print medium and a platen which supports the print medium, and is located opposite to the print head. The print head is linearly moved along the print medium. The platen includes first and second end portions and an intermediate portion, and is formed of material having stiffness. The first and second end portions are located at respective ends of the platen in the moving direction of the print head, and the intermediate portion is located between the first and second end portions. The first and second end portions are supported by respective spring members, such that they can be elastically displaced in a direction toward or away from the print head. The intermediate portion is formed to be more easily warped than the first and second end portions.

10 Claims, 8 Drawing Sheets

PRINTER HAVING A PLATEN

BACKGROUND OF THE INVENTION

1. Field of the Invention

The present invention relates to a printer provided with an impact type print head and a platen located opposite to the print head. To be more specific, the invention relates to the structure of a platen which receives an impact from a print head at the time of printing on a print medium.

2. Description of the Related Art

For example, an impact type printer comprises a print head which is linearly moved over a print medium, and a platen which supports the print medium. The print head has a number of wires projecting toward the print medium. When the wires hit an ink ribbon upon the print medium, characters, marks or the like are printed on the print medium. The platen extends in the moving direction of the print head, and is located opposite to the print head with respect to the print medium. The platen is hit by the wires of the print head at the time of printing on the print medium. Thus, the platen is required to have a sufficient strength to withstand the impacts from the print head.

It should be noted that a passbook which is an example of a print medium is thicker than an ordinary recording paper sheet, and it has a print region whose thickness is not uniform. The print head prints a row of characters, marks or the like each time it performs printing while being moved in its width direction. Thus, if the print medium has a print region whose thickness varies as in the passbook, the distance between the print head and the print medium varies as the print head is moved to print the print medium. As a result, the print density of a thick part of the print medium is different from that of a thin part of the print medium. Inevitably, the print quality is low.

In view of the above circumstances, a printer which handles a thick print medium such as a passbook uses a print head provided with rollers for pushing the print medium against the platen. In addition, both ends of the platen are elastically supported by respective springs. Thereby, the platen is displaced in a direction toward or away from the platen in accordance with the position of the print head. As a result, the positional relationship between the print head and the print medium is constant, thus improving the print quality.

Also, in a conventional printer, both ends of the platen are supported by respective springs as in the above printer. In this structure, the pressure acting on the center of the platen toward the print head is double that on each end of the platen. In other words, the reactive force of the platen against the wires of the print head is locally high, i.e., that of the center of the platen is great. Inevitably, the print density of the part of the print medium which corresponds to the center of the platen is high, and that of the parts of the print medium which correspond to the ends of the platen is low.

In order to solve such a problem, a conventional impact printer uses a flexible platen. This platen is formed of a material having an elastic modulus, and its height increases from either of its ends toward its center. The moment of inertia of a horizontal surface extending through the center of gravity of the platen increases from either of the ends toward the center. An impact printer having such a platen is disclosed in, e.g., U.S. Pat. No. 5,879,091.

In the impact printer disclosed in the U.S. patent, although the both ends of the platen are supported by respective springs, the reactive force of each of the ends of the platen is equivalent to that of the center of the platen. This feature thus prevents increasing of the print density of part of a print medium which corresponds to the center of the platen.

However, if a platen is easily warped such that the reactive forces of the ends of the platen are equivalent to that of the center of the platen, the reactive forces of parts of the platen which are located between the center of the platen and the ends of the platen, respectively, are increased.

Consequently, when a print head reaches each of the above parts of the platen which are located between the center of the platen and the ends of the platen, the print medium is strongly pushed against the rollers of the print head. Thus, especially if a pressure sensitive copying paper sheet is used as a print medium, the marks of the rollers are transferred onto the paper sheet. On the other hand, if the reactive force of the platen is lowered in order to avoid the above problem, the print density of the entire print region of the print medium decreases. Consequently, printing is unclear, and the print quality drops.

The object of the present invention is to provide a printer in which the reactive force of the platen is made uniform over the entire length thereof, and the print quality is improved.

BRIEF SUMMARY OF THE INVENTION

In order to attain the above object, a printer according to an embodiment of the present invention comprises a print head and a platen. The print head is linearly moved along a print medium to print the print medium. The platen supports the print medium, and is located opposite to the print head. The platen includes a first end portion, a second end portion and an intermediate portion, and is formed of material having stiffness. The first and second end portions are located at respective ends of the platen in the moving direction of the print head. The intermediate portion is located between the first and second end portions. The first and second end portions are supported by spring members such that they can be elastically displaced in the moving direction of the platen toward or away from the print head. The intermediate portion is formed to be more easily warped than the first and second end portions.

In the above structure, when the print head is moved along the platen, the platen is warped balanced by the pressures of the spring members, such that the intermediate portion of the platen is displaced by a given amount. Thus, the reactive force of the platen at the time of printing can be uniformized over the entire length of the platen. Therefore, the print density is kept constant, and printing of high quality is achieved.

Objects and advantages of the invention will become apparent from the description which follows, or may be learned by practice of the invention.

BRIEF DESCRIPTION OF THE SEVERAL VIEWS OF THE DRAWING

The accompanying drawings illustrate embodiments of the invention, and together with the general description given above and the detailed description given below, serve to explain the principles of the invention.

DETAILED DESCRIPTION OF THE INVENTION

An embodiment of the present invention will be explained with reference to FIGS. 1 to 12.

Figure 1:
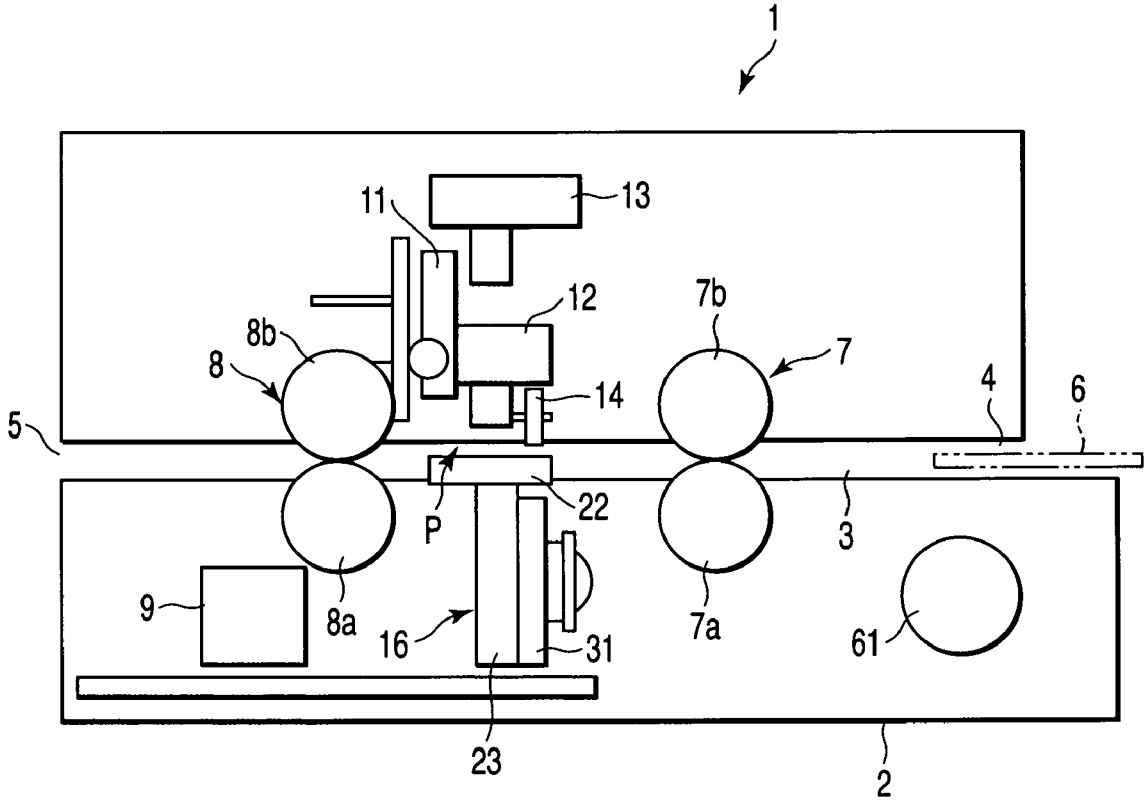
FIG. 1 is a side view of a printer according to an embodiment of the present invention.

FIG. 1 schematically shows the structure of an impact printer 1 by way of example. The impact printer 1 is provided with an apparatus body 2. In the apparatus body 2, a transfer path 3 is provided to transfer a print medium. An upstream end of the transfer path 3 communicates with an insertion slot 4 provided in the apparatus body 2. A downstream end of the transfer path 3 communicates with an ejection slot 5 provided in the apparatus body 2.

Figure 10:
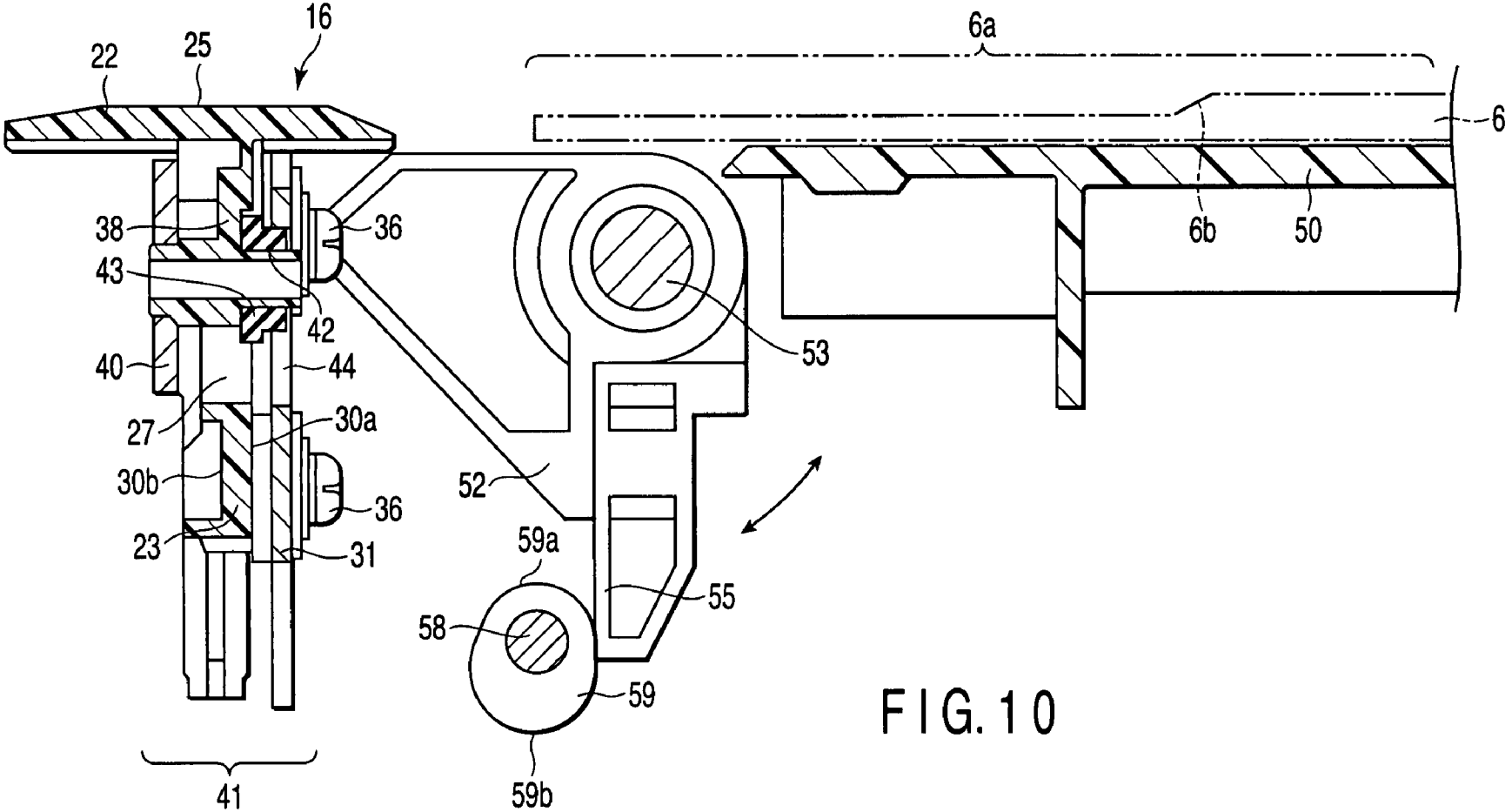
FIG. 10 is a cross section which shows a positional relationship between the platen assembly, a driving mechanism and a paper guide in the embodiment of the present invention.
Figure 11:
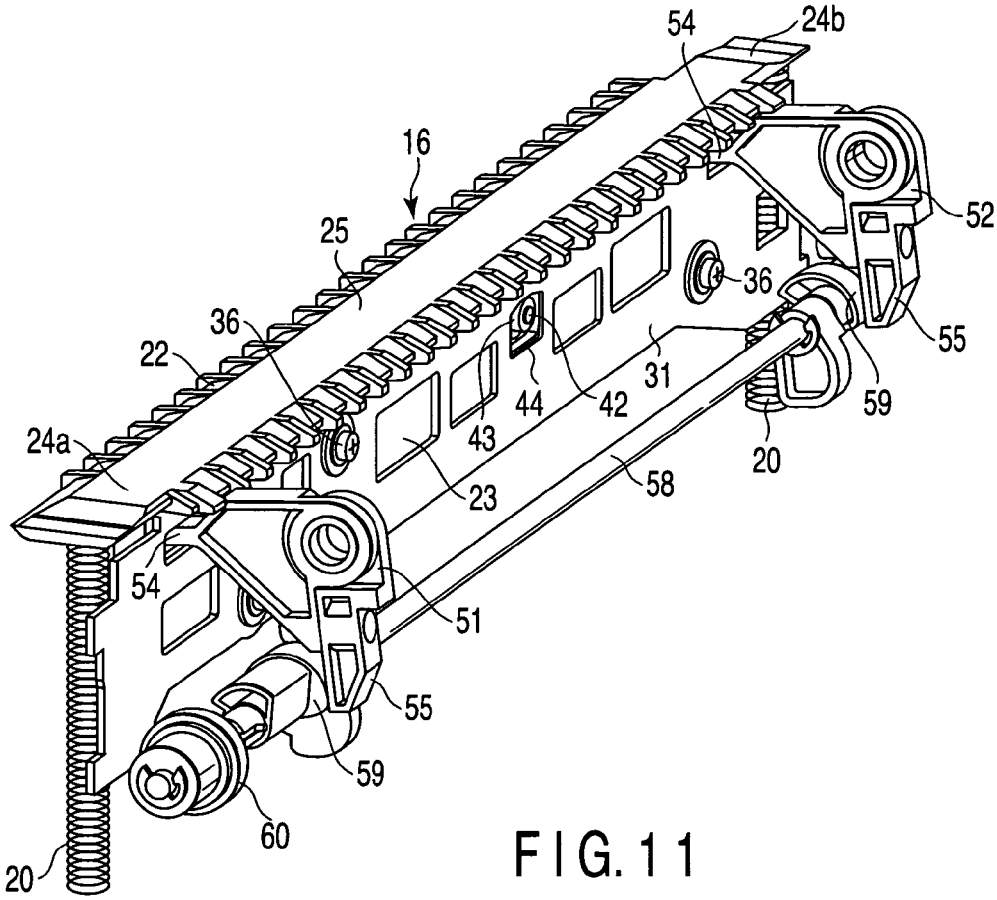
FIG. 11 is a perspective view which shows a positional relationship between the platen assembly and a driving mechanism which moves the platen assembly upwards and downwards.

In this embodiment, a passbook 6 is used as the print medium. The passbook 6 is inserted into the transfer path 3 through the insertion slot 4, while it is open. As shown in FIG. 10, the passbook 6 includes a print region 6*a* and a stepped portion 6*b*. The print region 6*a* is provided to extend between the left-hand page and right-hand page of the passbook 6. The stepped portion 6*b* extends at the center of the print region 6*a* in a direction perpendicular to the transferring direction of the passbook 6. Thus, in the passbook 6, the print region 6*a* varies in thickness with respect to the stepped portion 6*b*.

In the transfer path 3, a first roller unit 7 and a second roller unit 8 are provided in given positions, respectively. They are spaced apart from each other in the transferring direction of the passbook 6. The first roller unit 7 includes a pair of rollers 7*a* and 7*b*, and the second roller unit 8 includes a pair of rollers 8*a* and 8*b*. The pair of rollers 7*a* and 7*b* and the pair of rollers 8*a* and 8*b* are provided to transfer the passbook 6 while holding it. These rollers are rotated when receiving torque from a transfer motor 9.

The transfer path 3 includes a print section P for printing on the passbook 6. The print section P is located between the first roller unit 7 and the second roller unit 8. At the print section P, a carrier 11 is provided. To be more specific, the carrier 11 is located above the transfer path 3, and can be linearly reciprocated in the direction perpendicular to the transferring direction of the passbook 6.

The carrier 11 is provided with a print head 12 and an ink ribbon cassette 13. The print head 12 includes a number of wires not shown. At the time of printing, the wires are projected toward the print region 6*a* of the passbook 6. An ink ribbon is guided from the ink ribbon cassette 13 into the gap between the distal ends of the wires and the print region 6*a* of the passbook 6. Thus, when being linearly moved, e.g., in the width direction of the passbook 6, the print head 12 hits the ink ribbon on the print region 6*a* of the passbook 6 to print a row of characters, marks or the like on the print region 6*a*.

Furthermore, the print head 12 includes a pressing roller 14. The pressing roller 14 is intended to keep constant the distance between the print head 12 and the print region 6*a* of the passbook 6, and is projected more downwardly toward the passbook 6 than the print head 12.

As shown in FIG. 1, a platen 16 is provided below the print head 12. To be more specific, the platen 16 is located opposite to the print head 12 with respect to the transfer path 3, and extends in the moving direction of the print head 12. The platen 16 supports the passbook 6 from below when the passbook 6 reaches the print section P. In other words, the passbook 6 is held between the platen 16 and the pressing roller 14 of the print head 12. Thus, the passbook 6 is pressed against the platen 16 by the pressing roller 14, thereby setting the distance the passbook 6 and the print head 12 at a predetermined value. Thus, the platen 16 is repeatedly hit by the wires of the print head 12 at the time of printing on the passbook 6.

The platen 16 is made of material such as glass-reinforced plastic, which has a sufficient stiffness, so that it can withstand the impacts from the print head 12. As shown in FIGS. 2 to 5, the platen 16 includes a first end portion 17, a second end portion 18 and an intermediate portion 19. The first end portion 17 is located at one of the ends of the platen 16 in the moving direction of the print head 12. The second end portion 18 is located at the other end of the platen 16 in the moving direction of the print head 12. The intermediate portion 19 is located between the first end portion 17 and the second end portion 18, and extends in the longitudinal direction of the platen 16.

The first and second end portions 17 and 18 of the platen 16 are supported by the apparatus body 2, with compression coil springs 20 interposed between the first and second end portions 17 and 18 and the apparatus body 2, respectively. Each of the compression coil springs 20 is an example of a spring member. The compression coil springs 20 continuously push the first and second end portions 17 and 18 of the platen 16 upwardly toward the print head 12. Thus, the platen 16 can be elastically displaced from its original position toward the print head 12 or away from the print head 12 in accordance with the thickness of the passbook 6.

The platen 16 includes a main body 22 and a beam 23. The main body 22 extends in the moving direction of the print head 12, and is also formed in the shape of a plate which is flat and elongated in the transferring direction of the passbook 6. The main body 22 includes two ends 24*a* and 24*b* and a supporting surface 25. The end 24*a* is located at the first end portion 17 of the platen 16. The end 24*b* is located at the second end portion 18 of the platen 16. That is, the ends 24*a* and 24*b* are separated from each other in the longitudinal direction of the main body 22. The supporting surface 25 is intended to support the passbook 6, and is interposed between the ends 24*a* and 24*b*.

The beam 23 extends between the ends 24*a* and 24*b* of the main body 22. The beam 23 projects downwards from a center portion of the main body 22, which is located at the center of the main body 22 in the width direction thereof. The beam 23 has a cross section which is narrower in width than that of the main body 22. The beam 23 has a greater section modulus than that of the main body 22. The stiffness of the beam 23 is higher than that of the main body 22. Therefore, the platen 16 has a T-shaped cross section.

The beam 23 includes a pair of ends 26*a* and 26*b*. The end 26*a* is located at the first end portion 17 of the platen 16. The end 26*b* is located at the second end portion 18 of the platen 16. The ends 26*a* and 26*b* of the beam 23 are pushed upwards by the compression coil springs 20.

The end 26*a* of the beam 23 and the end 24*a* of the main body 22 are formed integral with each other. Similarly, the end 26*b* of the beam 23 and the end 24*b* of the main body 22 are formed integral with each other. Thus, the main body 22 and the beam 23 are formed as a single body. As a result, the platen 16 is stabilized with respect to the strength. In addition, the inertia of the platen 16 is increased, since the weight of the beam 23 is added to the main body 22.

Figure 2:
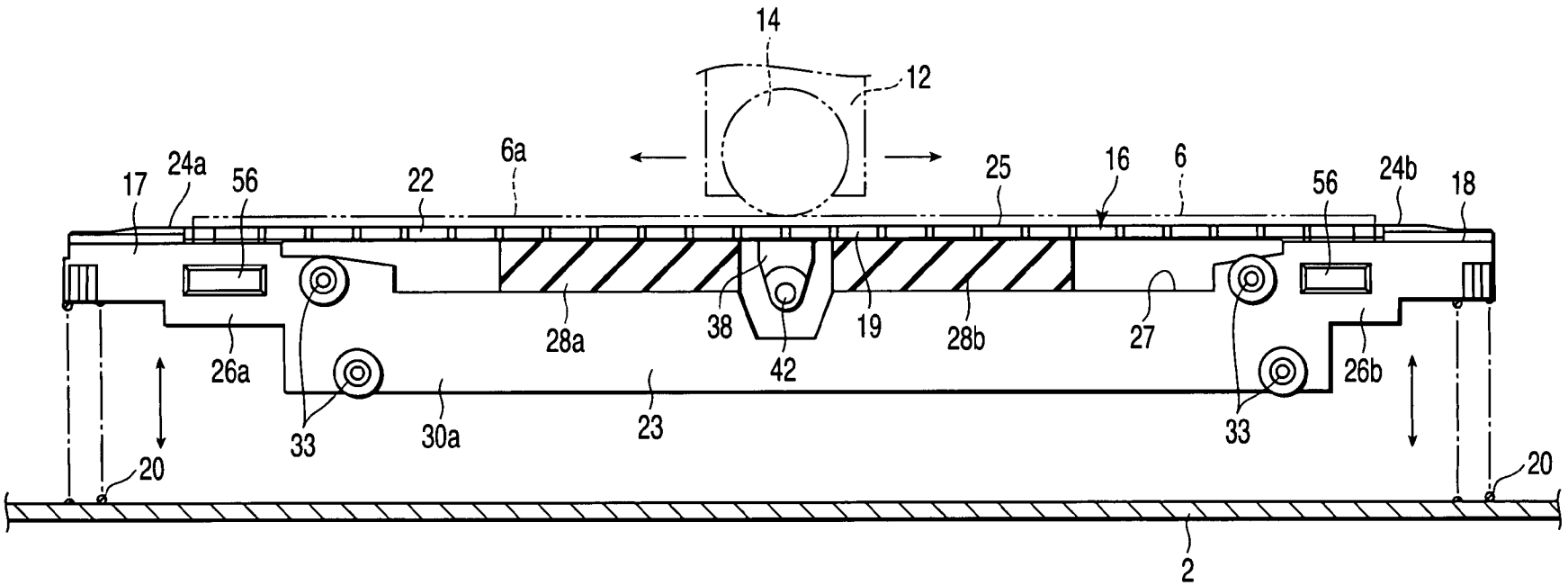
FIG. 2 is a side view showing a positional relationship between a platen and a print head in the embodiment of the present invention.
Figure 3:
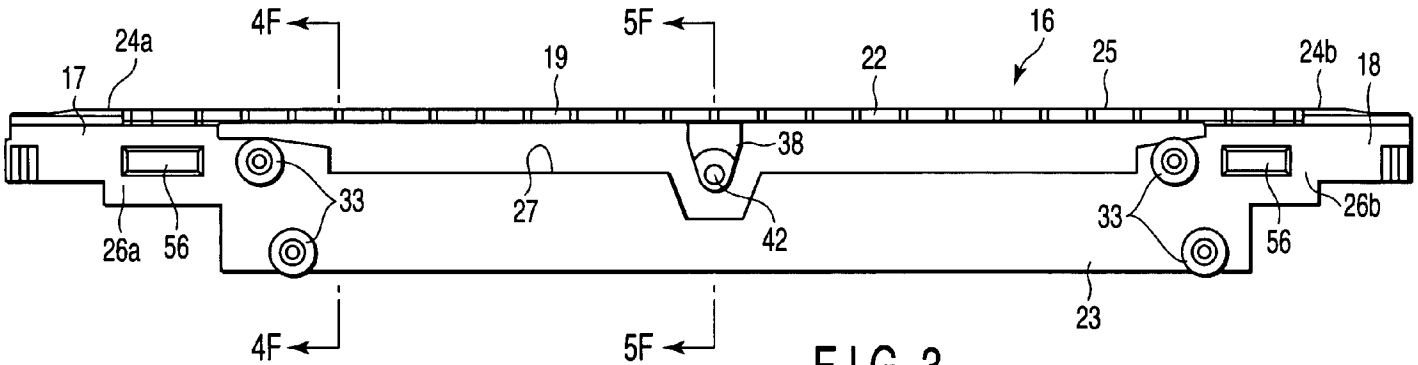
FIG. 3 is a side view of the platen in the embodiment of the present invention.

As shown in FIGS. 2 and 3, the beam 23 is spaced apart from the main body 22 in a position corresponding to that of the intermediate portion 19 of the platen 16. In other words, an elongated hole 27 is formed in the intermediate portion 19 of the platen 16. The hole 27 is located below the supporting surface 25 of the main body 22, and extends in the longitudinal direction of the platen 16 along the moving direction of the print head 12.

Figure 5:
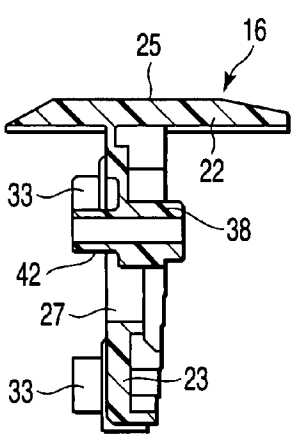
FIG. 5 is a vertical section taken along line F5-F5 in FIG. 3.
Figure 4:
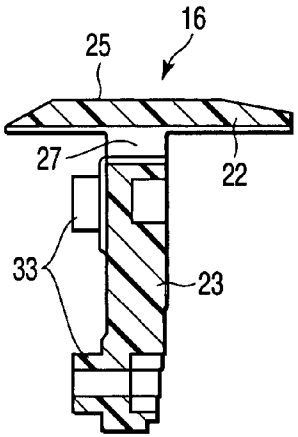
FIG. 4 is a vertical section taken along line F4-F4 in FIG. 3.

As shown in FIGS. 4 and 5, the thickness of the center of the beam 23 in the longitudinal direction thereof is smaller than that of each of the ends 26*a* and 26*b* of the beam 23. Therefore, the section modulus of the intermediate portion 19 of the platen 16 is smaller than that of each of the first end portion 17 and the second end portion 18 of the platen 16. Thus, the intermediate portion 19 of the platen 16 easily warps, as compared with the first and second end portions 17 and 18.

As shown in FIG. 2, a pair of elastic members 28*a* and 28*b* formed of rubber are situated between the lower surface of the main body 22 and the upper edge of the beam 23. The elastic members 28*a* and 28*b* are spaced apart from each other in the longitudinal direction of the platen 16. The elastic members 28*a* and 28*b* are provided in the hole 27 of the platen 16, and are located at the intermediate portion 19 of the platen 16. In other words, the elastic members 28*a* and 28*b* elastically support the main body 22 from below, at the intermediate portion 19 of the platen 16.

The elastic members 28*a* and 28*b* are different from the platen 16 in modulus of elasticity. In the embodiment, the modulus of elasticity of each of the elastic members 28*a* and 28*b* is higher than that of the platen 16. Thus, the elastic members 28*a* and 28*b* are elastically deformed in accordance with the impact applied to the supporting surface 25 of the platen 16.

Figure 7:
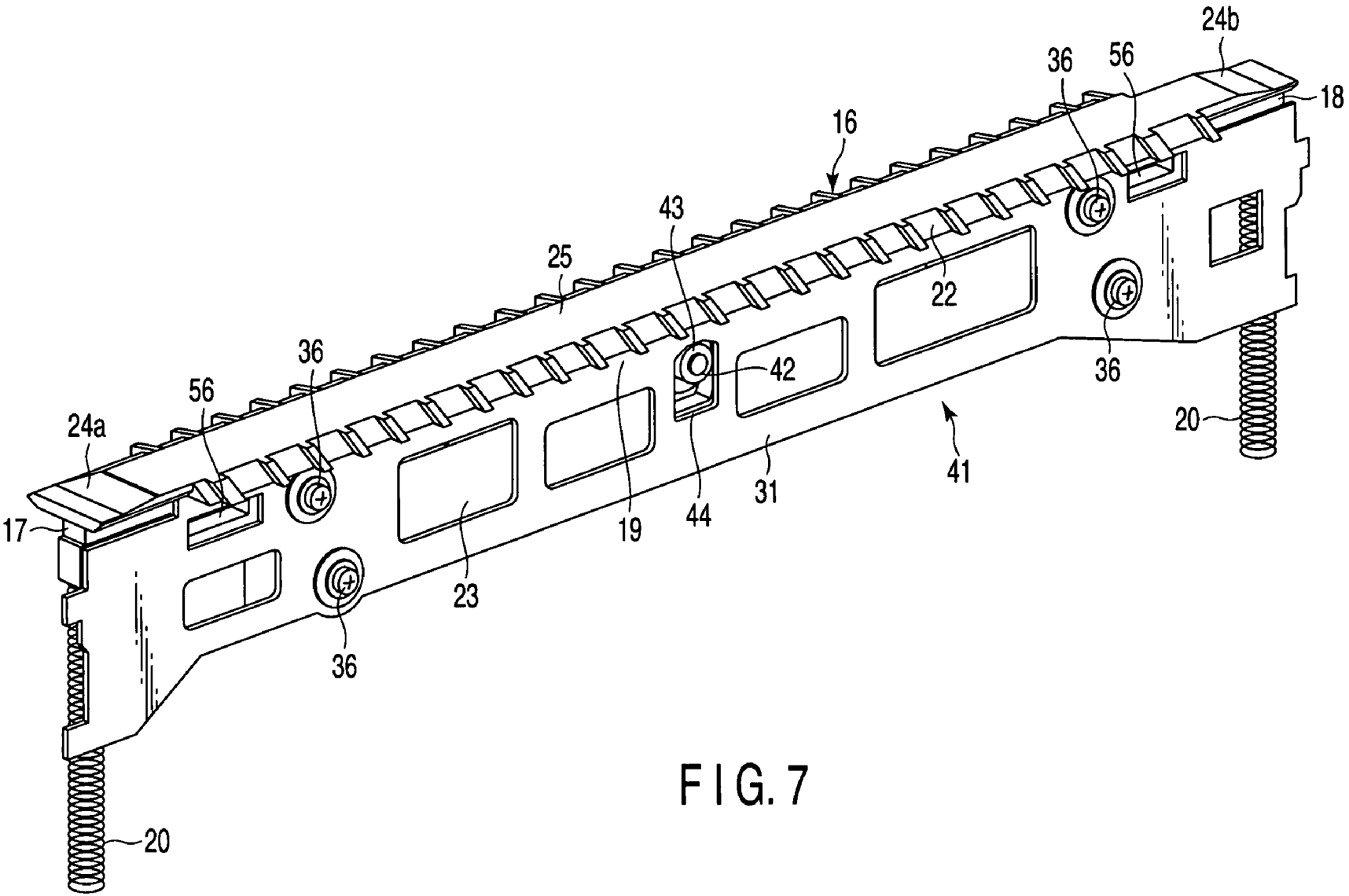
FIG. 7 is a perspective view of the platen assembly in the embodiment of the present invention.

The beam 23 of the platen 16 includes a front surface 30*a* and a rear surface 30*b* located opposite to the front surface 30*a*. To the front surface 30*a* of the platen 16, a first mass member 31 formed as shown in FIG. 7 is attached. The first mass member 31 is formed of, e.g., a steel plate. The mass of the first mass member 31 is greater than that of the platen 16, and the stiffness of the first mass member 31 is higher than that of the platen 16. The first mass member 31 extends in the longitudinal direction of the beam 23, and has such a size as to cover the front surface 30*a* of the beam 23.

Figure 8:
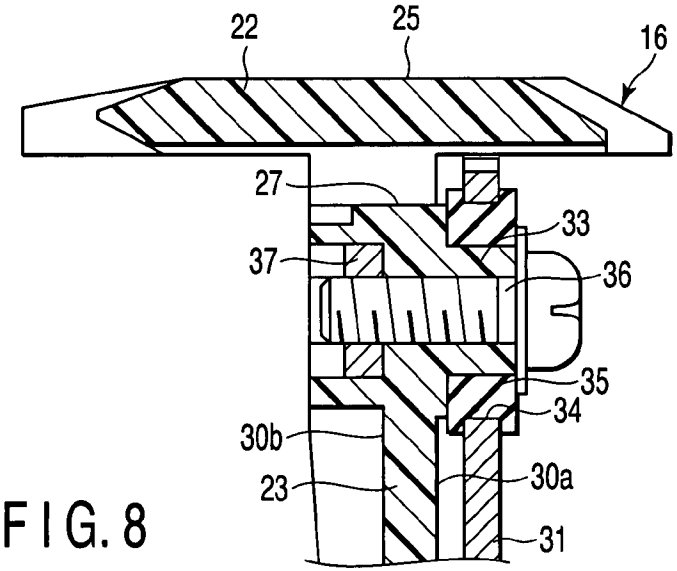
FIG. 8 is a vertical section of the platen assembly, which shows the structure of a connected portion between the platen and the first mass member in the embodiment of the present invention.
Figure 9:
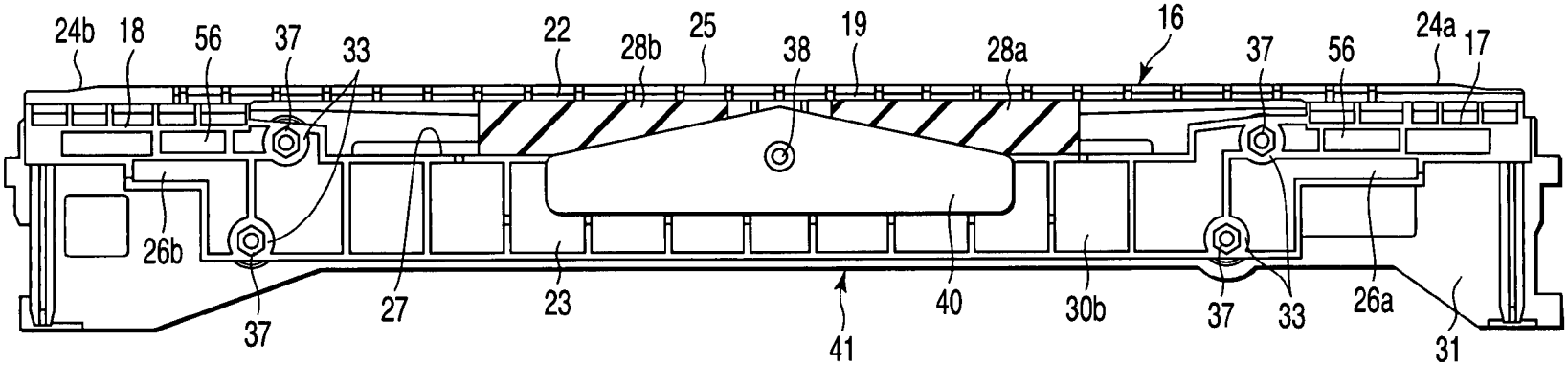
FIG. 9 is a side view of the platen assembly, which shows a positional relationship between the platen, the elastic member, the first mass member and a second mass member in the embodiment of the present invention.

The beam 23 includes pairs of boss portions 33 which are located adjacent to ends 26*a* and 26*b*. As shown in FIG. 8, the boss portions 33 project from the front surface 30*a* of the beam 23, and extend through holes 34 formed in the first mass member 31. Elastic rings 35 formed of rubber are held between the first mass member 31 and the boss portions 33. Each of the elastic rings 35 is an example of an elastic member. The elastic rings 35 are held by the boss portions 33 due to screws 36. The screws 36 penetrate the boss portions 33, and are screwed into nuts 37. As a result, the first mass member 31 is elastically held by the beam 23, with elastic rings 35 interposed therebetween.

Figure 6:
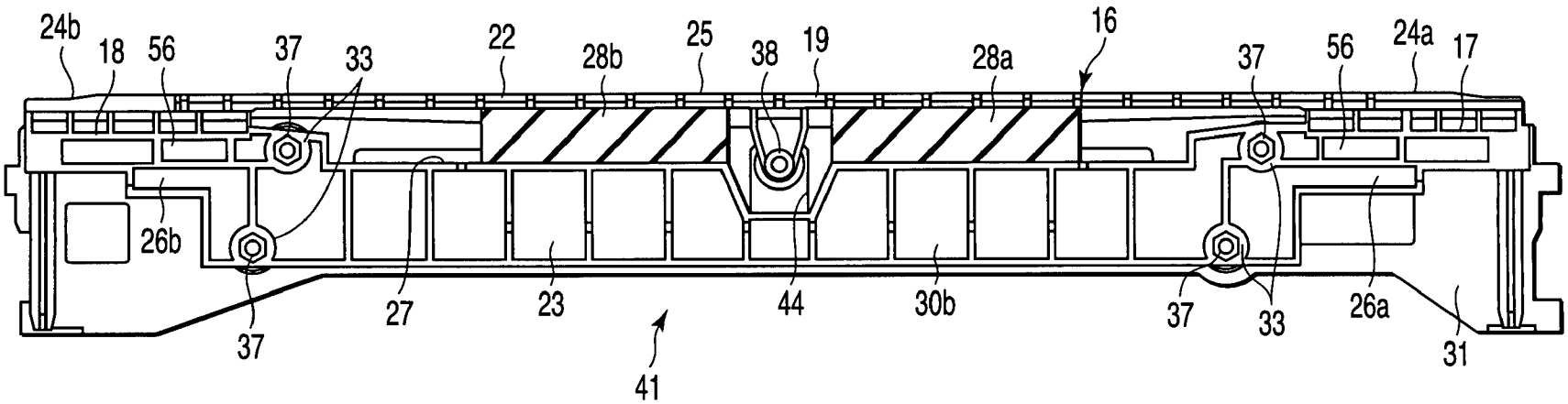
FIG. 6 is a side view of a platen assembly, which shows a positional relationship between the platen, an elastic member and a first mass member in the embodiment of the present invention.

As shown in FIGS. 3, 6 and 10, the main body 22 includes a bracket 38. The bracket 38 projects from the center portion of the main body 22 which is located at the center in the longitudinal direction thereof, toward the hole 27, and is located between the elastic members 28*a* and 28*b*.

The bracket 38 supports a second mass member 40. The second mass member 40 is formed of, e.g., a steel plate, and is smaller than the first mass member 31. The mass of the second mass member 40 is greater than that of the platen 16, and the stiffness of the second mass member 40 is higher than that of the platen 16. The second mass member 40 is exposed toward the rear surface 30*b* of the beam 23, and is located in the center of the beam 23 in the longitudinal direction.

In such a manner, the first and second mass members 31 and 40 and the platen 16 are formed as a single body to form a platen assembly 41.

Figure 12:
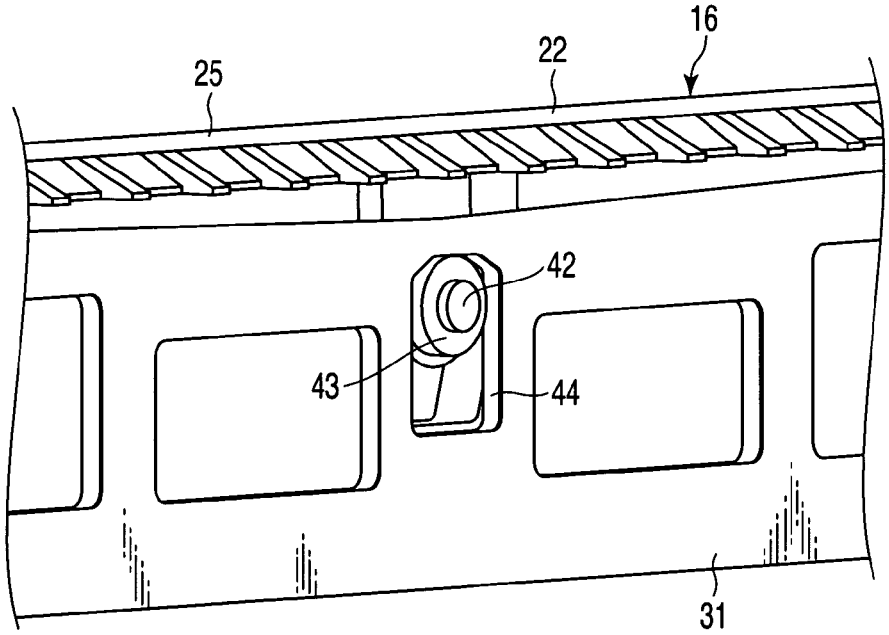
FIG. 12 is a perspective view of the platen assembly, which shows a stopper provided at the platen and the first mass member.

As shown in FIGS. 10 and 12, the bracket 38 includes a stopper 42. The stopper 42 holds an elastic ring 43 formed of rubber. The elastic ring 43 is exposed toward the front surface 30*a* of the beam 23, and is located in an opening portion 44 formed in the first mass member 31. The elastic ring 43 is continuously in contact with an upper edge of the opening portion 44, thereby preventing the main body 22 of the platen 16 from being deformed in such a manner as to warp upwards.

The platen 16 having the above structure is pushed downwards against the urging forces of the compression coil springs 20, so as not to interfere with transferring of a thick print medium like the passbook 6, at the time of transferring it.

As shown in FIGS. 10 and 12, a paper guide 50 for guiding the passbook 6 to the platen 16 is provided with a pair of arms 51 and 52. The arms 51 and 52 are separated from each other in the longitudinal direction of the platen 16, and are supported by the apparatus body 2 such that they are rotatable around pivot shafts 53.

The arms 51 and 52 include engagement portions 54 and cam followers 55. The engagement portions 54 extend through the first mass member 31, and are engaged with a pair of engagement holes 56 formed in the beam 23 of the platen 16. The cam followers 55 extend toward positions below the pivot shafts 53.

A cam shaft 58 is provided below the arms 51 and 52. The cam shaft 58 includes a pair of cams 59. The cams 59 include base circles 59*a* and cam noses 59*b* projecting from the base circles 59*a*. The base circles 59*a* and the cam noses 59*b* contact the cam followers 55.

A driving wheel 60 is fixed to one of the ends of the cam shaft 58. The driving wheel 60 is driven along with a relay wheel not shown in interlock with a driving motor 61 shown in FIG. 1. Thus, the torque of the driving motor 61 is transmitted to the cam shaft 58 by the relay wheel and the driving wheel 60, thereby rotating the cams 59 located on the cam shaft 58. The arms 51 and 52 are held in a given state with respect to the platen 16 as long as the base circles 59*a* of the cams 59 contact the cam followers 55. As a result, the platen 16 is pushed upwards by the compression coil springs 20 to a level higher than the level of the paper guide 50.

When the cam followers 55 are shifted from the base circles 59*a* onto the cam noses 59*b*, the arms 51 and 52 are rotated downwards. Due to this rotation of the arms 51 and 52, the platen 16 is forcibly pushed downwards by the engagement portions 54 of the arms 51 and 52. Thus, the platen 16 is retreated to a level lower than that at which the paper guide 50 is located.

When the cam followers 55 are shifted from the cam noses 59*b* onto the base circles 59*a*, the platen 16 is released from downward pushing by the arms 51 and 52. Thus, the platen 16 is pushed upwards by the compression coil springs 20. As a result, the platen 16 is moved up and down each time a row of characters, marks or the like are printed on the passbook 6.

In the impact printer 1 having the above structure, when the passbook 6 reaches the print section P, the platen 16 is pushed upwards by the compression coil springs 20. Thereby, the passbook 6 is held between the supporting surface 25 of the platen 16 and the pressing roller 14 of the print head 12. Thus, the passbook 6 is fixed to the supporting surface 25, and at the same time the distance between the print region 6*a* of the passbook 6 and the print head 12 is set at the predetermined value.

In the case of printing on the print region 6*a* of the passbook 6, for example, when the print head 12 is moved from the right side to the left side in FIG. 2, the first end portion 17 of the platen 16 is moved downwards against the urging force of an associated one of the compression coil springs 20. On the other hand, the second end portion 18 of the platen 16 is moved upwards by the urging force of the other end of the compression coil springs 20.

The intermediate portion 19 of the platen 16 is more easily warped than the first and second end portions 17 and 18, since its section modulus is smaller than those of the first and second end portions 17 and 18. Furthermore, the elastic members 28*a* and 28*b* provided between the beam 23 and the main body 22 of the platen 16 are elastically deformed to absorb warping of the main body 22 which occurs when the main body 22 supports the passbook 6, and finely adjust the degree of deformation of the main body 22 in accordance with the position of the print head 12.

That is, at the first and second end portions 17 and 18 of the platen 16 which receive the urging forces of the compression coil springs 20, the platen 16 has a double-deck structure in which the main body 22 and the beam 23 are provided, and at the intermediate portion 19 of the platen 16 which is easily warped, the platen 16 has a three-deck structure in which the main body 22, the beam 23 and the elastic members 28*a* and 28*b* are provided.

The intermediate portion 19 of the platen 16 is warped balanced, against the pressures of the compression coil springs 20 supporting the platen 16, such that the main body 22 and the elastic members 28*a* and 28*b* are displaced in accordance with the position of the print head 12, and generates a reactive force toward the print head 12.

Therefore, when the print head 12 is moved to print a row of characters, marks or the like on the print region 6*a* of the passbook 6, the reactive force of the platen 16 toward the print head 12 can be made uniform over the entire length of the platen 16. As a result, the print densities of the characters, marks or the like printed on the print region 6*a* are equivalent, thus achieving printing with a high quality.

When the intermediate portion 19 of the platen 16 is easily warped, there is a possibility that the main body 22 of the platen 16 may be deformed to be warped toward the print head 12. Thus, the main body 22 of the platen 16 includes the stopper 42 at the center of the platen 16 in the longitudinal direction thereof. The stopper 42 is in contact with an upper edge of the opening portion 44 of the first mass member 31, with the elastic ring 43 interposed between the stopper 42 and the upper edge of the opening portion 44. The elastic ring 43 contacts the first mass member 31 to restrict free deformation of the main body 22 toward the print head 12.

Thus, though the intermediate portion 19 of the platen 16 is easily warped, the supporting surface 25 of the main body 16 is formed to be uniformly flat. Therefore, clear printing can be achieved, and the printing quality is improved.

By virtue of the above structure, the reactive force of the platen 16 is kept optimal for printing, and is made uniform over the entire length of the platen 16. Thus, for example, even if a pressure sensitive copying paper sheet is used as the print medium, the pressing rollers 14 are prevented from leaving marks on the paper sheet when the print head 12 is moved. In addition, when the stepped portion 6*b* of the passbook 6 reaches the print head 12, the platen 16 is smoothly moved downwards in accordance with the thickness of the passbook 6, and the platen 16 warps balanced. Thus, the print head 12 is not caught by the stepped portion 6*b* of the passbook 6.

Furthermore, the weight of the beam 23 is added to the platen 16, since the main body 22 of the platen 16 is reinforced by the beam 23, which has a higher stiffness than that of the main body 22. Also, the weights of the first and second mass bodies 31 and 40 are added to the platen 16, since the first and second mass members 31 and 40, each of which has a higher specific gravity than that of the platen 16, are attached to the beam 23 of the platen 16. Thus, the inertia of the platen 16 is increased.

Therefore, when the passbook 6 is printed, fine vibration, which would occur at the platen 16 when the print head 12 repeatedly hits the platen 16, can be suppressed. Furthermore, the vibration of the beam 23 is absorbed by the elastic rings 35 provided between the first mass member 31 and the beam 23.

Therefore, vibration of the platen 16 at the time of printing can be efficiently reduced, thus preventing noise.

In the above embodiment, the beam and the main body of the platen are formed integral with each other. However, in the invention, the structure of the beam and the main body are not limited to such a structure. For example, the beam and the main body may be formed separately, and be connected with each other by screws or the like.

Furthermore, the main body and the beam may be formed of different materials. In this case, it is preferable that material having a high modulus of vertical elasticity be used as the material of the beam.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the inventive as defined by the appended claims and their equivalents.

What is claimed is:

1. A printer comprising:

(i) a print head which is linearly moved along a print medium to print on the print medium;

(ii) a platen which supports the print medium and is located opposite to the print head, and which includes:

a first end portion located at one end of the platen in a moving direction of the print head;

a second end portion located at another end of the platen in the moving direction of the print head;

an intermediate portion located between the first and second end portions;

a main body including two ends which are separated from each other in the moving direction of the print head; and a beam which extends between the two ends of the main body and which has a stiffness higher than a stiffness of the main body, wherein a part of the beam corresponding to the intermediate portion is spaced apart from the main body to form a hole between the beam and the main body extending in the moving direction of the print head; and (iii) a plurality of spring members which support the first and second end portions of the platen so as to be elastically deformable in a moving direction of movement of the platen toward or away from the print head, wherein the print head includes a roller which presses the print medium against the platen to keep a distance between the print head and the print medium constant, and a section modulus of the intermediate portion of the platen is smaller than a section modulus of each of the first and second end portions of the platen, whereby the intermediate portion of the platen is deformable and more easily warped than the first and second end portions of the platen.

2. The printer according to claim 1, wherein the main body and the beam are formed to be integral with each other.

3. The printer according to claim 1, further comprising an elastic member which is provided in the hole between the main body and the beam, and which has a modulus of elasticity higher than a modulus of elasticity of the main body.

4. The printer according to claim 1, further comprising a mass member attached to the platen, with an elastic member interposed between the mass member and the platen, wherein the mass member has a specific gravity higher than a specific gravity of the platen.

5. The printer according to claim 4, wherein the main body includes a stopper which is in contact with the mass member in a position corresponding to the intermediate portion of the platen, thereby keeping the main body flatly shaped.

6. The printer according to claim 1, wherein the print medium includes a print region to be printed by the print head, and has a thickness which varies in the print region.

7. A printer comprising:

(i) a print head which is linearly moved along a print medium to print on the print medium, and which includes a roller that contacts the print medium;

(ii) a platen which is located opposite to the print head, and which includes:

a first end portion located at one end of the platen in a moving direction of the print head;

a second end portion located at another end of the platen in the moving direction of the print head;

an intermediate portion located between the first and second end portions;

a main body including two ends which are separated from each other in the moving direction of the print head and a supporting surface, which is interposed between the two ends, to support the print medium and hold the print medium in cooperation with the roller such that a distance between the print head and the print medium is kept constant;

a hole formed in the intermediate portion to penetrate the platen below the supporting surface; and a beam extending between the ends of the main body, the hole being located between the main body and the beam; and (iii) a plurality of spring members which support the first and second end portions of the platen so as to be elastically deformable in a direction of movement of the platen toward or away from the print head;

wherein the intermediate portion of the platen has a section modulus which is smaller than a section modulus of each of the first and second end portions of the platen, whereby the intermediate portion of the platen is deformable and more easily warped than the first and second end portions of the platen.

8. The printer according to claim 7, further comprising an elastic member which is provided in the hole, supports the main body from a side on which the beam is located, and has a modulus of elasticity higher than a modulus of elasticity of the main body.

9. The printer according to claim 7, further comprising a mass member attached to the platen, with an elastic member interposed between the mass member and the platen, wherein the mass member has a specific gravity higher than a specific gravity of the platen.

10. A printer comprising:

a print head which is linearly moved along a print medium to print on the print medium, and which includes a roller that contacts with the print medium;

a platen which supports the print medium and is located opposite to the print head, and which includes: (i) a first end portion located at one end of the platen in a moving direction of the print head, (ii) a second end portion located at another end of the platen in the moving direction of the print head, (iii) an intermediate portion located between the first and second end portions, (iv) a supporting surface which holds the print medium between the supporting surface and the roller, (v) a main body including two ends which are separated from each other in the moving direction of the print head, with the supporting surface interposed between the two ends, and (vi) a beam extending between the two ends of the main body, wherein a part of the beam corresponding to the intermediate portion is spaced apart from the main body to form a hole between the beam and the main body extending in the moving direction of the print head; and a plurality of spring members which support the first and second end portions of the platen so as to be elastically deformable in a direction of movement of the platen toward or away from the print head;

wherein the intermediate portion of the platen has a section modulus which is smaller than a section modulus of each of the first and second end portions of the platen, whereby the intermediate portion of the platen is deformable and more easily warped than the first and second end portions of the platen.

* * * * *